United States Patent [19]

Pedersen

[11] 3,947,049

[45] Mar. 30, 1976

[54] MONO-SKI

[76] Inventor: Alec Pedersen, 896 E. 35th Ave., Vancouver, British Columbia V5W 1B3, Canada

[22] Filed: Nov. 5, 1974

[21] Appl. No.: 521,103

[52] U.S. Cl. .....280/11.13 S; 280/11.13 L
[51] Int. Cl.[2] ..... A63C 5/12
[58] Field of Search 280/11.13 W, 11.13 S, 11.13 L, 280/11.13 R, 11.13 Y, 11.13 T, 28, 12 K, 12 H, 12 R

[56] References Cited

UNITED STATES PATENTS

| | | | |
|---|---|---|---|
| 1,888,455 | 11/1932 | Eriksen | 280/11.13 W |
| 2,616,715 | 11/1952 | Billings | 280/11.13 S X |
| 3,154,312 | 10/1954 | Marchand | 280/11.13 W |
| 3,685,846 | 8/1972 | Schmid | 280/11.13 W |
| 3,758,127 | 9/1973 | Doyle et al. | 280/11.13 S |
| 3,802,714 | 4/1974 | Freegard | 280/11.13 W |
| 3,854,738 | 12/1974 | Fish | 280/11.13 W |

FOREIGN PATENTS OR APPLICATIONS

| | | | |
|---|---|---|---|
| 1,435,153 | 3/1966 | France | 280/11.13 L |
| 749,836 | 1/1967 | Canada | 280/11.13 L |
| 1,262,624 | 4/1961 | France | 280/11.13 L |

*Primary Examiner*—M. Henson Wood, Jr.
*Assistant Examiner*—Milton L. Smith
*Attorney, Agent, or Firm*—Fred Philpitt

[57] ABSTRACT

A monoski comprises an elongated body having a central waist portion, an upwardly curved forward tip and an upwardly tapered and outwardly flared tail portion. The monoski has its greatest thickness and minimum width at the central waist portion, and is reduced in thickness both towards the tail portion and the forward tip, the minimum thickness being adjacent the tip. The side edges flare outwardly towards the tip to a ski width, and then the side edges converge to join at the tip proper. The widest region near the tip is hereinafter called the "tip region." Thus, the tip region whose maximum width is about 6½ inches is wider than the central waist portion, whose maximum width is about 6¼ inches and the tail portion whose maximum width is about 7⅓ inches is substantially wider than the tip region. The ski also has a greater-than-normal camber, i.e., 12 – 14 mm (about 4¾–5½ inches) for a ski of length 90 – 180 cm (about 35½–72⅞ inches). Ski bindings are mounted on the central waist portion for holding the feet of a skier in close side-by-side relation. The ski bindings extend slightly over the side edges of the ski. Such a new and improved monoski is more easily controlled and safer to use than conventional dual skis, not only in powder snow, but also in hard packed or corn snow.

5 Claims, 11 Drawing Figures

MONO-SKI

BACKGROUND OF THE INVENTION

This invention relates to a monoski, namely, a ski which is adapted to support both feet of a skier and including means for securing both feet or boots of the skier directly over the ski and alongside each other.

SUMMARY OF THE PRIOR ART

Monoskis of the above character have been disclosed in U.S. Pat. No. 3,154,312 patented by Jacques Marchard on Oct. 27, 1964. As taught in that patent, the desirability of a single ski on which to ride was based on the greater challenge thereby offered to skiers, in that more skill would be required than by using two skis. Another desirable feature was based on its greater safety in that it would avoid twisting a leg when the skier falls, which often happens when using two skis. If the skier on the monoski should fall, the legs would both turn with the body and there would be very little, if any, injurious twisting of the legs. With that monoski, sharp turns could be made and the ski braked to be brought to a stop without assisting accessories. To provide a ski having the foregoing advantages, however, the patentee found that it was essential to secure a pair of boot fasteners to the ski proper so that they would be directly over the ski and also would be alongside each other. It was also found to be essential that such bindings not extend beyond the sides of the ski, at least not substantially.

U.S. Pat. No. 3,685,846 patented by Hans Schmid on Aug. 22, 1972 relates to improvements in such monoskis of the kind in which a single conventional ski body member, formed with a gliding surface, is provided with two ski bindings fixed on the ski body member in side-by-side arrangement, each binding having a toe portion and a heel portion. Such known monoskis comprised a rigid supporting plate to which the ski bindings, including toe and heel portions, were screwed. Skiing with this known ski, however, has shown certain aspects which hinder its running performance.

In the first place, such known monoski is substantially rigid in its waist portion, which carried the supporting plate of the ski binding. This rigid waist portion was adjacent to forward and tail portions having the required elasticity and flexibility. This structure provided discontinuous transitions of the elastic properties of the gliding member of this monoski and tended to result in a loosening or tearing off of the screws by means of which the supporting plate was fixed to the gliding member, thus rendering the ski unfit after only a short time of use.

That patentee provided a novel construction of a monoski in which the components supporting the toe and heel portions of the ski binding are so formed that the ski body portion provided with the gliding surface allegedly did not have any rigid waist portion. This was alleged to have been provided in a ski having a single ski body member formed with a gliding surface, and two ski bindings mounted on the body member in side by side arrangement, each binding having a toe portion and a heel portion. A support was provided for the toe portion, and a support was provided for the heel portion. The two supports were fixed one behind the other in longitudinally spaced relation on the ski body. Furthermore, in order to facilitate the action of the ski edges during running and to keep the width of the ski body portion in the order of magnitude of a conventional ski without having the sole edges of the ski-boot making contact with the track when laterally inclining the ski during turning manoeuvers, the ski-boot supporting surface on the toe and heel portions of the binding was raised a distance above the ski body member corresponding substantially to the width of the ski.

The ski body member provided with the gliding surface as taught by that patentee was a conventional ski, i.e., one having a width from 7 to 10 centimeters (about 2¾ to about 4 inches) and a length of 210 centimeters (about 6 feet 10¾ inches) when the ski is destined to be used by a person of 175 centimeters (about 5 feet 9 inches) height.

Another improvement in monoskis was provided in U.S. Pat. No. 3,802,714 patented by Stephen D. Freegard on Apr. 9, 1974. In that patent a deck structure was provided which could be added to one of a conventional pair of skis so that the single ski could be used as a monoski. Thus, the deck structure included a two-part pedestal, the parts of which were relatively reciprocable in one vertical plane of the pedestal, and adapted to be superposed on a ski and interengaged with the bindings thereof. The deck structure also included a two-part platform which was mounted on the pedestal to support the skier. The parts of the platform were also relatively reciprocable in the vertical plane of the pedestal, so that the binding on the parts of the platform, adjacent the upper surface thereof, could be interengaged with the boots of the sier. When the parts of the pedestal were interengaged with the bindings of the ski, the parts of both the pedestal and the platform were fixed in relation to one another. However, it was also taught that the parts of the platform should be relatively reciprocable in conjunction with the parts of the pedestal, and vice versa, automatically to transfer the functional relationship between the bindings of the ski, to the binder means on the parts of the platform.

Yet another improvement in monoskis was provided in U.S. Pat. No. 3,758,127 patented by Michael D. Doyle and William L. Bahne, J. R. on Sept. 11, 1973. The single ski described in that patent is much wider and shorter than conventional skis and, due to its large concentrated area, was said to ride well on soft snow. Both feet were held in close side by side position in any suitable type of bindings or boot retainers, the constant secure leg position making control more positive. It was alleged by the patentee that fast turns could be made at any speed with a minimum of effort and body motion, and that sharp pivot turns were possible as opposed to the usually long sliding turns made with dual skis. In a fall, the feet remained together and the skier could retain more control over the body and limbs to avoid injury.

The performance of the single ski disclosed in the above patent was said to be not merely the result of the short wide shape. The pattern of flexibility through the ski was said to be important and there was a definite configuration that was said to be essential to ensure proper action. In such patented monoski, the central body portion was very stiff, the tail was torsionally flexible and the nose or tip was even more flexible. Very little bottom camber was used and the ski did not have the pronounced hourglass shape used in most conventional skis to allow a tight radius turn. The patented ski had almost straight sides for high speed stability, yet was said to be capable of sharp turns due to its novel design.

The patented ski had a length-to-width ratio on the order of 9 or 10 to 1. The patentee discussed the importance of proper torsional resistance. In a turn the tail of the ski was said to act as a rudder and was therefore said to bite into the snow without twisting away from the turn. The nose or tip must have enough torsional resistance to hold a traverse across a slope, but still be able to twist and release from the snow from a turn. A tip that is torsionally too stiff will tend to climb or hook into a slope and; if too soft, it will twist away from the surface and not hold a traverse. The patentee stated that a ski which was too stiff overall, or one which was too flexible, overall, did not have the performance of the properly proportioned patented ski.

OBJECTIVES OF THE INVENTION

While monoskis as above described are useful in powder snow, they are most difficult to control and to use in hard-packed or corn snow.

An object, then, of an aspect of this invention is to provide a new and improved single ski on which both feet are held in close side-by-side relation.

An object of another aspect of this invention is to provide a new and improved single snow ski which is more easily controlled and safer to use than conventional dual skis, not only in powder snow, but in hard packed or corn snow.

SUMMARY OF THE INVENTION

By a broad aspect of this invention, a single snow ski is provided comprising: an elongated body having a central waist portion having a maximum width of about 6¼', an upwardly curved forward tip region having a maximum width of about 6½ inches and an upwardly tapered and outwardly flared tail portion having a maximum width of about 7⅓ inches, the ski having its greatest thickness at the central waist portion, and being reduced in thickness both towards the tail portion and the forward tip region, the minimum thickness being adjacent the forward tip region, and wherein the forward tip region is defined by side edges flaring outwardly from the central waist portion towards the forward end of the ski, and then converging to join together at the tip, such forward tip region being wider than the central waist portion, and wherein the tail portion is wider than the forward tip region; and retaining means mounted on the ski adjacent the central waist portion for holding the feet of a skier in close side-by-side relation, with such retaining means extending over the side edges of the ski.

BRIEF DESCRIPTION OF EMBODIMENTS OF THE INVENTION

In one embodiment, the ski is from 90 to 185 cm (about 35½ inches to about 6 feet 1 inch) long, is about 16.5cm (about 6½ inches) wide at the forward tip region, is 15.3cm (about 6 inch) wide at the central waist portion and is at least 18.5cm (about 7⅓ inches) wide at the tail portion. Thus, in view of the essential variations in width of the ski at particular areas, there is no significance to any length-to-width ratio, as has been proposed in the past.

It has been found that, in use, a Venturi effect is created which gives extremely reliable control. This effect is due to the particular configuration of ski which is directly contrary to the configuration of the monoskis of the prior art, i.e., by having the forward tip region wider than the waist portion, and by having the tail portion substantially wider than the forward tip region.

DETAILED DESCRIPTION OF ONE PREFERRED EMBODIMENT

Figure 1:
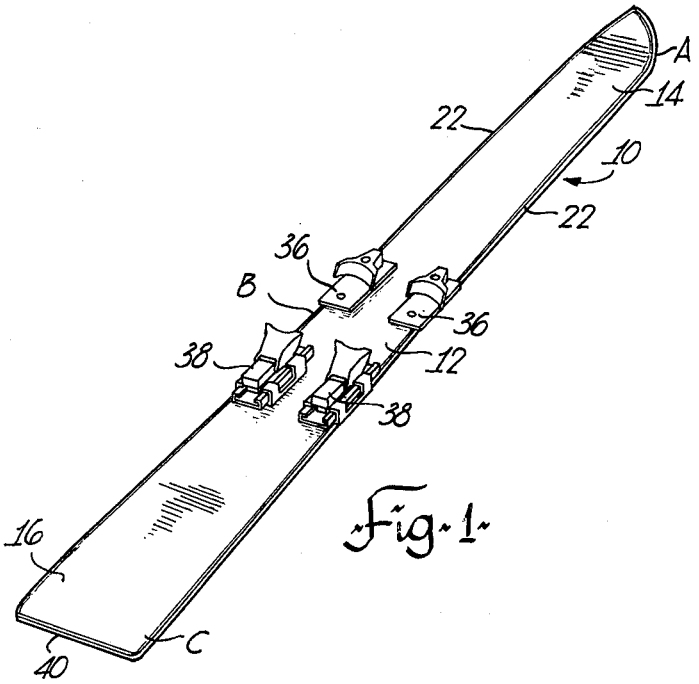
FIG. 1 is a perspective view of a monoski according to one aspect of this invention.

The monoski 10 comprises an elongated body with a central waist portion 12, and an upwardly curved forward tip region 14 and an outwardly flared tail portion 16. Each side edge 22 may be provided with a conventional steel wear resistant edge. The underside of the ski has a running surface 30 of polyethylene, or a similar plastic material, having a pair of parallel longitudinal grooves 32 extending adjacent the forward tip 14 along substantially the full length of the body. Grooves 32 allow the ski to unstick from the snow more readily and to reduce friction in running. A single groove or more than two grooves could however be used if desired. The tail portion 16 of the ski is slightly upwardly tapered and is preferably protected by a reinforcing strip 40 of metal or the like.

In plan form the ski is shorter than a conventional ski and is, on the average, approximately three to four times the width. While the exact dimensions may vary to suit the rider and the required performance characteristics, the basic proportions of a tested efficient ski are given below as typical.

In one embodiment, the ski has a length of 180cm (about 5 feet 11 inches). The width of the forward tip region is 16.5cm (about 6½ inches), the width at the central waist portion is 15cm (about 5⅞ inches) and the width at the tail portion is at least 17.7cm (about 7 inches). The bindings 36, 38, are located 5cm (about 2 inches) rearward of the center part of the longitudinal axis. They are set to extend from 0.56cm to 1.12cm (about ¼ to ½ inch) over the lateral edges 22 of the monoski 10.

The grooves commence 35cm (about 13¾ inches) from the forward tip 14 and continue right through to the tail portion 16. The lateral positioning of the longitudinal grooves 32 is approximately one-third of the ski width and the depth is approximately 2 to 3 mm (about ¾ inches to about 1 1/5 inches). The bottom of the monoski 10 tapers up slightly at the tail portion 16. In addition, the camber of the monoski 10 is greater than that of conventional skis.

Figure 10:
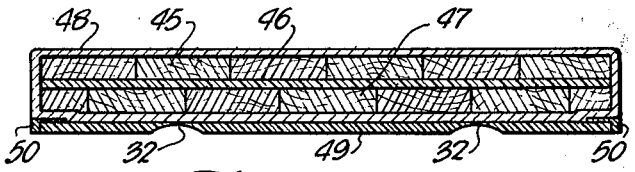
FIG. 10 is a central, transverse cross-section of one embodiment of an aspect of this invention.
Figure 11:
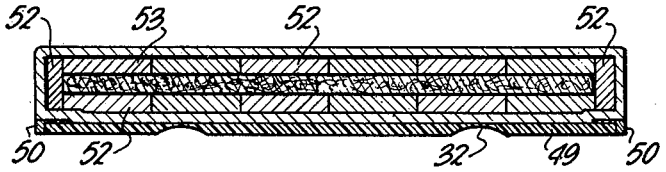
FIG. 11 is a central, transverse cross-section of another embodiment of another aspect of this invention.

The materials out of which the monoski may be made and typical transverse cross-sections of embodiments of aspects of this invention are shown in FIGS. 10 and 11. In FIG. 10 it is seen that the core of monoski 10 includes a laminate of hickory 45, glass-fiber sheet 46 and ash 47, enveloped with a sheet of airplane aluminum 48. The running surface 49 is formed of polytetrafluoroethylene or any other suitable plastics material, having a pair of grooves 32 therein.

In FIG. 11, there is shown a hard foam core 51 with a stiffening pair of layers of ash sheet 52 with an envelope of a sheet of fiberglass 53. The running surface 49 is formed of polytetrafluoroethylene or any other suitable plastics material, having a pair of grooves 32 therein. The feet of the skier are held in side-by-side position on the central waist portion 12 of the monoski 10 by any suitable bindings or boot retainers, represented as toe grips 36 mounted on binding plates 37 and heel clamps 38 mounted on binding plates 39. Many different bindings and quick release fittings are available, and since they do not form part of this invention need not be discussed further. Suitable securing means can be incorporated on the monoski 10 where needed.

The monoski 10 is simple to ride with both feet held together on the single platform, represented by the monoski 10 and there is no tendency for the feet to separate and get out of control in extreme maneuvers. Very tight pivot turns can be made at substantially any speed without any substantial loss of stability. The turning radius can be as little as one third of that possible with conventional dual skies. The wide area enables the monoski 10 to plane effectively and to ride high in soft snow, which also facilitates maneuvering. In a fall, the risk of injury is greatly reduced, since the feet do not fly in different directions, each with a long unwieldy ski attached.

It has been found that the precise interrelationship of the configuration of the monoski 10 and the placement of the bindings 36, 38 causes the turning characteristics to be altered from that of normal skis. Such characteristics become superior, and it is possible to effect turns uphill more smartly, faster and with greater safety, and to effect turns downhill to the fall line with equally smooth characteristics. The bindings 36, 38 may be set side by side or may be moved, one slightly ahead of the other. It is preferred, however, that the bindings 36, 38 be set parallel to each other, equidistant from the forward tip 14 and the tail portion 16.

The waist effect, and the relative widths of the forward tip region 14 and the tail portion 16 provide the stability and directional characteristics that are superior to conventional skis. Such interrelationship also creates a Venturi effect which provides greater speed despite the increased flat, plain area of the monoski 10.

It is believed that the likelihood of injury in the case of use of the monoski 10 is reduced because the legs are together. The majority of accidents result from crossed or diverging skis, with or without proper bindings. Preferred bindings are side release bindings of the safety type. They should be set 30 to 40 percent looser than is the usual practice. In test falls, a skier has been found to come down without discomfort in a sitting position. It is believed that this is due to the characteristics of the skis in unusual attitudes, and the weight of the skier is essentially towards the rear.

DETAILED DESCRIPTION OF A SECOND PREFERRED EMBODIMENT

Figure 2:
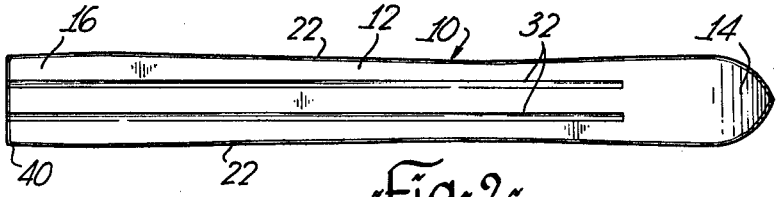
FIG. 2 is a bottom plan view of the monoski of FIG. 1.
Figure 3:
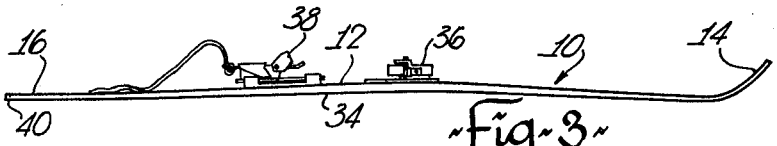
FIG. 3 is a side elevational view of the monoski of FIG. 1.
Figure 5:
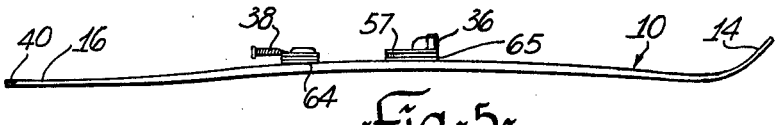
FIG. 5 is a side elevational view of the monoski of FIG. 4.
Figure 4:
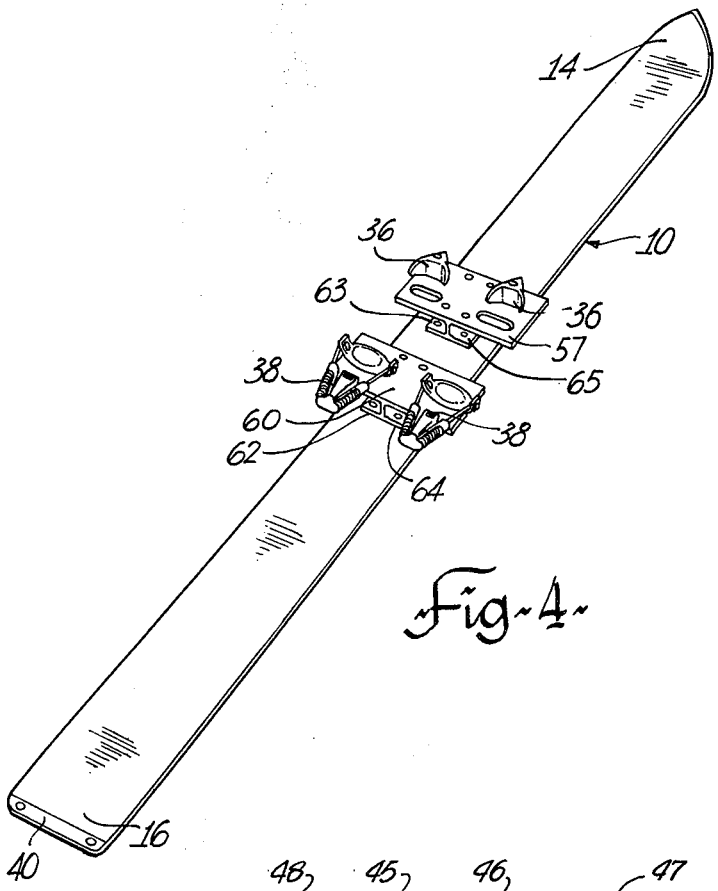
FIG. 4 is a perspective view of a monoski according to another aspect of this invention.

As seen in FIGS. 4 and 5 the monoski 10 also consists of a single ski as described in FIGS. 1–3, including a waist portion 12, a wide forward tip region 14 and a still wider tail portion 16. The monoski 10 has mounted thereon two bindings 52 and 53. The bindings 52 are provided with a pair of forward jaw portions 54, and the bindings 53 are provided with a pair of heel portions 56, in the represented example being shown as safety checks 54 and automatic heel release devices 56. The two jaw portions 54 are fixed to a front pedestal support 58 and the two heel portions 56 are fixed to a rear pedestal support 59.

The bindings supports 58 and 59 each include a carrier plate 60 and 61, respectively, situated in the same plane and forming the forward and rear supporting surfaces, respectively, for the sole of a ski boot (not shown).

The carrier plates 60 and 61 are supported by a web 62 and 63, respectively fixed to the respective carrier plate 64, 65 respectively or formed integral therewith as a section of a double-T beam extending in a plane at right angles to the ski surface and parallel to its longitudinal axis. The lower flanges 64 and 65, respectively, of the double-T sections are, for example, secured to the ski body portion by means of screws.

The two supports 58 and 59 accordingly have the profile of a double-T of which the carrier plate 60, 61 forms the larger, upper flange. In the drawing as shown the supports are assembled from semi-finished material available in commerce, i.e., from plates and profiles for example, by welding or rivetting; the supports also could be formed as integral molded parts, for example cast from a light-weight alloy.

Figure 6:
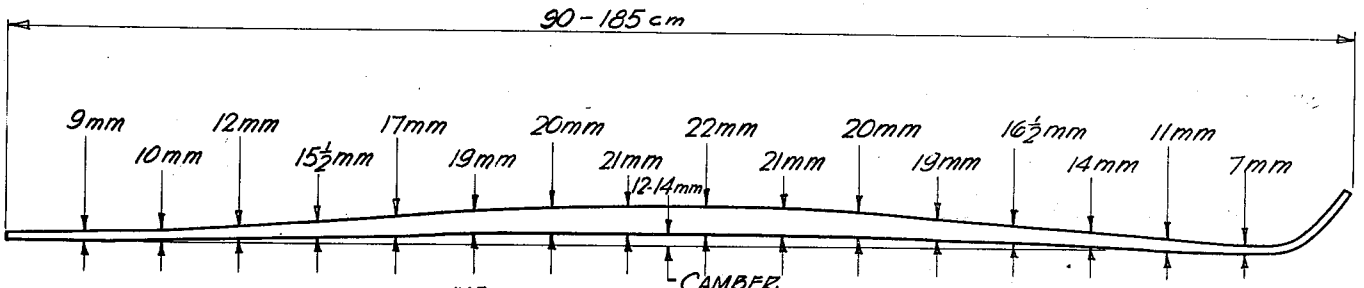
FIG. 6 is a central cross-sectional view of a monoski indicating the thickness and camber thereof of a typical monoski of one embodiment of this invention.
Figure 7:
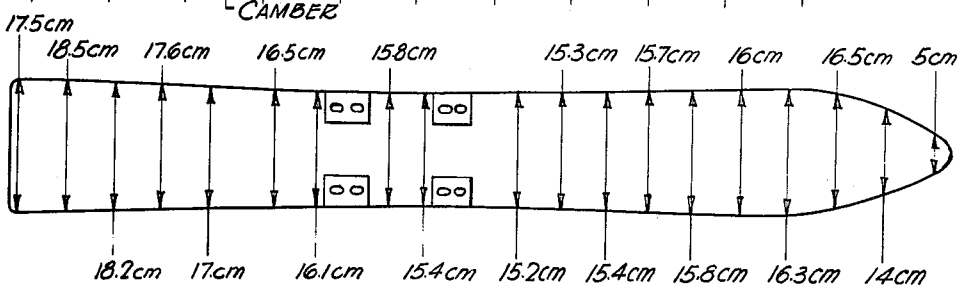
FIG. 7 is a top plan view of the monoski of FIG. 6.

The fixings of the flanges 64, 65 of the supports 58 54 can be effected through the intermediary of a layer of resiliently yielding rubber or foam rubber (not shown) of a thickness of a few millimeters. Turning now to FIGS. 6 and 7 there is seen typical interrelationship of ski thickness (in FIG. 6) and ski width, (in FIG 7) for a typical monoski according to this invention having a length of from 90 – 185 cm (about 35½ to about 6 feet ⅛ inch) The interrelationships are summarized below in the table.

| | Ski Thickness (mm) (FIG. 6) | Inches approx. | Ski Width (cm) (FIG. 7) | Inches approx. |
|---|---|---|---|---|
| | 7 | 1/4 | 5.0 | 2 |
| | 7 | 1/4 | 14.0 | 5 1/2 |
| (tip region) | 7 | 1/4 | 16.5 | 6 1/2 |
| | 11 | 2/5 | 16.3 | 6 2/5 |
| | 14 | 1/2 | 16.0 | 6 3/10 |
| | 16.5 | 2/3 | 15.8 | 6 1/5 |
| | 19 | 3/4 | 15.7 | 6 1/5 |
| | 20 | 4/5 | 15.4 | 6 |
| | 21 | 4/5 | 15.3 | 6 |
| (waist area) | 22 | 7/8 | 15.2 | 6 |
| | 21 | 4/5 | 15.4 | 6 |
| | 20 | 4/5 | 15.8 | 6 1/5 |
| | 19 | 3/4 | 16.1 | 6 1/3 |
| | 17 | 2/3 | 16.5 | 6 1/2 |
| | 15.5 | 3/5 | 17.0 | 6 7/10 |
| | 12 | 1/2 | 17.6 | 6 9/10 |
| | 10 | 2/5 | 18.2 | 7 1/8 |
| (tail portion) | 9 | 1/3 | 18.5 | 7 8/10 |
| | 9 | 1/3 | 17.5 | 6 7/8 |

It will be observed, moreover, that the camber at the waist area is 12 – 14 mm (about ½ to about 3/5 inch). While the tip and the tip region have been shown as a uniform 7 mm (about ⅓ inch) thickness, the thickness may vary to provide a degree of "softness" which can vary for weight variations of skiers. Thus, the tip may taper in thickness to provide a softer tip for a 150 lb. skier or it may be thicker than 7 mm (about 3/10 inch), i.e., 8 mm (about ⅓ inch) thick to provide a stiffer tip for a 200 lb. skier; or may be up to 9 or more mm (about 2/5 inch or more) thick to provide a hard tip for a 250 lb. skier.

Figure 8:
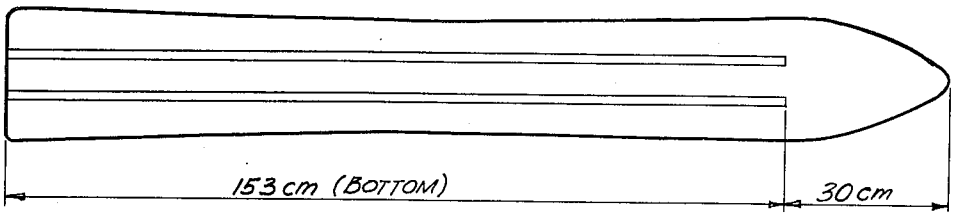
FIG. 8 is a bottom plan view of the monoski of FIG. 6.

Shown in FIG. 8 is the bottom view of a ski 183 cm long. The twin grooves are set equidistant from the center line and are 6 cm (about 2⅓ inches) apart, and are 1 – 2 mm (about 4/100 to about 8/100 inch) wide and 1 mm (about 4/100 inch) deep. They extend from 30 cm (about 11 4/5 inches) from the tip of the ski to the tail edge.

Figure 9:
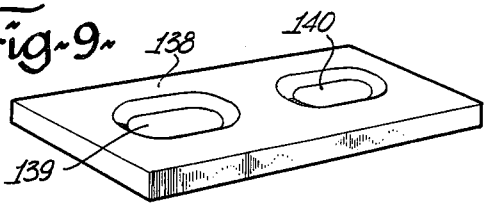
FIG. 9 is an isometric view of a typical binding plate used in conjunction with the present invention.

FIG. 9 shows a typical varaition of a binding plate 138, preferably made of aluminum and typically 5.5 cm (about 2 1/5 inches) wide and 17.5 cm (about 6 9/10 inches) long. Two slots 139 are provided with cambered edges 140. This permits the flush attachment of screws, and allows slidable adjustment for ideal setting for individuals.

SUMMARY

Thus by the present invention in its many aspects, a monoski is provided which is of sufficient width to hold both feet in close side-by-side position in conventional bindings or boot retainers. The ski has a relatively stiff central waist portion, with a flexible tip region, a flexible, outwardly flared tail and a maximum bottom camber. The relationship of the width at the tip region, at the waist portion and at the tail portion is important to the performance of the ski. Advantages of the monoski provided herein are extreme maneuverability, good pivot turnability, controlled turns at all speeds and good suport on powder snow and excellent maneuverability in both packed and corn snow. From the foregoing description, one skilled in the art can easily ascertain the essential characteristics of this invention, and without departing from the spirit and scope whereof, can make various changes and modifications of the invention to adapt it to various usages and conditions. Consequently, such changes and modifications are properly, equitable, and "intended" to be, within the full range of equivalence of the following claims.

I claim:

1. A moniski comprising: an elongated body having a central waist portion having a maximum width of about 6¼ inches, an upwardly curved forward tip region of maximum width about 6½ inches and an upwardly tapered and outwardly flared tail portion of maximum width about 7⅓ inches, said ski having its greatest thickness at the central waist portion, and being reduced in thickness both towards the tail portion and the forward tip, the minimum thickness being adjacent the forward tip region, and wherein the forward tip region is wider than the central waist portion, and the tail portion is substantially wider than the forward tip region; and including bindings monted on said ski adjacent said central waist portion for holding the feet of a skier in close side-by-side relation, with the bindings extending slightly over the side edges of the ski.

2. The monoski of claim 1 wherein the ski is about 90 – 185 cm long, (about 35 4/10 to about 72 8/10 inches long), is about 16.5 – 14.5 cm wide, (about 6½ to about 5 7/10 inches wide) at the forward tip region, is about 15.2 – 13.4 cm wide, (about 6 to about 5 3/10 inches wide) at the central waist portion and is at least about 17.7 – 18.5 cm wide, (about 7 to about 7 3/10 inches wide) at the tail portion.

3. The monoski of claim 1 wherein the ski is 22 mm thick (about ⅞ inches thick) at the central waist portion, is 11 mm thick (about 7/16 inch thick) at the forward tip region and is 9 mm thick (about ⅓ inch thick) at the tail portion.

4. The monoski of claim 1 wherein the bindings include a pair of toe members monted parallel to one another on individual base plates, each said base plate being secured directly onto the ski, and a pair of heel members mounted parallel to one another on individual base plates, each said base plate being secured directly onto the ski.

5. The monoski of claim 1 wherein the bindings comprise a pair of toe members mounted side-by-side parallel to one another on a pedestal, said pedestal being secured to the monoski, and a pair of heel members mounted side-by-side parallel to one another on a pedestal, said pedestal being secured to the monoski.

* * * * *